US007825317B1

(12) United States Patent
Lederman et al.

(10) Patent No.: US 7,825,317 B1
(45) Date of Patent: Nov. 2, 2010

(54) FOODSTUFF-BASED WIND INSTRUMENT

(76) Inventors: Eran Lederman, P.O. Box 165, Matta (IL) 99870; Elan Leor, 9 Feivel Street, Tel-Aviv (IL) 62995

( * ) Notice: Subject to any disclaimer, the term of this patent is extended or adjusted under 35 U.S.C. 154(b) by 0 days.

(21) Appl. No.: 12/437,194

(22) Filed: May 7, 2009

Related U.S. Application Data

(60) Provisional application No. 61/051,113, filed on May 7, 2008.

(51) Int. Cl.
*G10D 7/00* (2006.01)

(52) U.S. Cl. ..... 84/330; 84/380 R; 84/384

(58) Field of Classification Search ..... 84/330, 84/380 R, 384; 426/104, 443 R, 443; D17/10; 446/204, 204 R
See application file for complete search history.

(56) References Cited

U.S. PATENT DOCUMENTS

| | | | | | |
|---|---|---|---|---|---|
| 229,163 | A | * | 6/1880 | Mills | 446/204 |
| 247,850 | A | * | 10/1881 | Rector | 446/204 |
| 255,250 | A | * | 3/1882 | Bulger | 446/204 |
| 452,706 | A | * | 5/1891 | Hoops | 446/204 |
| 530,039 | A | * | 11/1894 | Gardiner | 426/104 |
| 628,670 | A | * | 7/1899 | McNamara | 446/204 |
| 1,567,284 | A | * | 12/1925 | Miller | 426/515 |
| 1,593,026 | A | * | 7/1926 | Madle | 446/204 |
| 1,609,791 | A | * | 12/1926 | Broadwell | 426/104 |
| 2,417,480 | A | * | 3/1947 | Friedman | 446/205 |
| 2,617,324 | A | * | 11/1952 | Brody | 84/330 |
| 2,619,865 | A | * | 12/1952 | Lynch | 84/330 |
| 2,739,065 | A | * | 3/1956 | Hugin | 426/104 |
| 2,859,555 | A | * | 11/1958 | Paige | 446/206 |
| 3,415,009 | A | * | 12/1968 | Knauf | 446/81 |
| D288,140 | S | * | 2/1987 | Fontlladosa | D1/106 |
| D293,615 | S | * | 1/1988 | Blatnick | D1/106 |
| D293,616 | S | * | 1/1988 | Blatnick | D1/106 |
| D309,274 | S | * | 7/1990 | Gray | D10/119 |

(Continued)

OTHER PUBLICATIONS

Pasta Whistle, Leor/Lederman Industrial Design (inventors), viewed Feb. 2, 2010 at http://www.leor-lederman.com/pasta.*

(Continued)

*Primary Examiner*—Jeffrey Donels
*Assistant Examiner*—Robert W Horn
(74) *Attorney, Agent, or Firm*—Martin Fleit; Paul D. Bianco; Fleit Gibbons Gutman Bongini & Bianco PL

(57) ABSTRACT

Wind instrument made of flour based foodstuff, such as dried dough for the preparation of pasta, the wind instrument formed as a tubular envelope defining a cavity with two ends, where the first end is open, enabling a user of the wind instrument to blow air into the open end to generate sound while the second end is being sealed, the tubular opening having a labium opening, the second end of the cavity being selectively sealed, such as by a finger of the user, or fixedly sealed, such as during the manufacturing, the tubular envelope having at least one fingerhole that is selectively openable and closeable while the user is blowing air through the open end, enabling adjustment of the tone or tone pitch of the generated sound.

17 Claims, 8 Drawing Sheets

U.S. PATENT DOCUMENTS

| | | | | |
|---|---|---|---|---|
| D313,951 | S * | 1/1991 | Mizisko | D10/119 |
| D326,554 | S * | 6/1992 | Meyers et al. | D1/106 |
| 6,183,334 | B1 * | 2/2001 | Gant | 446/204 |
| D568,128 | S * | 5/2008 | Kelleghan | D8/38 |
| 2005/0037112 | A1 * | 2/2005 | Daley et al. | 426/104 |
| 2007/0202219 | A1 * | 8/2007 | Kolz | 426/104 |

OTHER PUBLICATIONS

Pasta Whistle, by Leor-Lederam, another posting of the product by the inventor, posted Oct. 27, 2009, viewed Jun. 7, 2010 at http://freshbump.com/pasta-whistle/.*

* cited by examiner

125/121
101
110
115
131
120/121

125/121
101
110
131
115
120/121
H
H

125/121
101
110
131
115
120/121
SECTION H-H

125/121
101
110
131
115
120/121

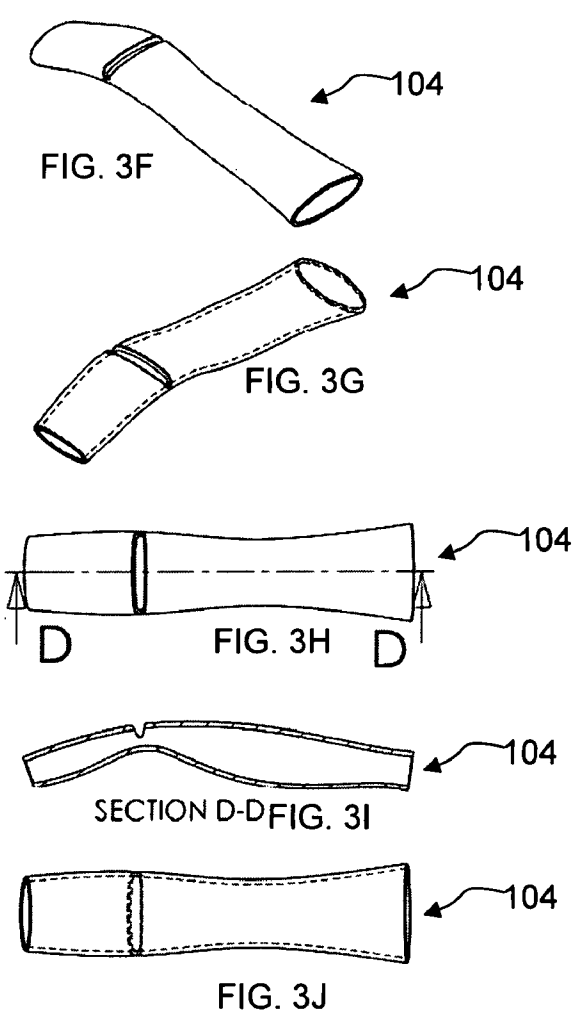
104
FIG. 3F
104
FIG. 3G
104
D
D
FIG. 3H
104
SECTION D-D
FIG. 3I
104
FIG. 3J
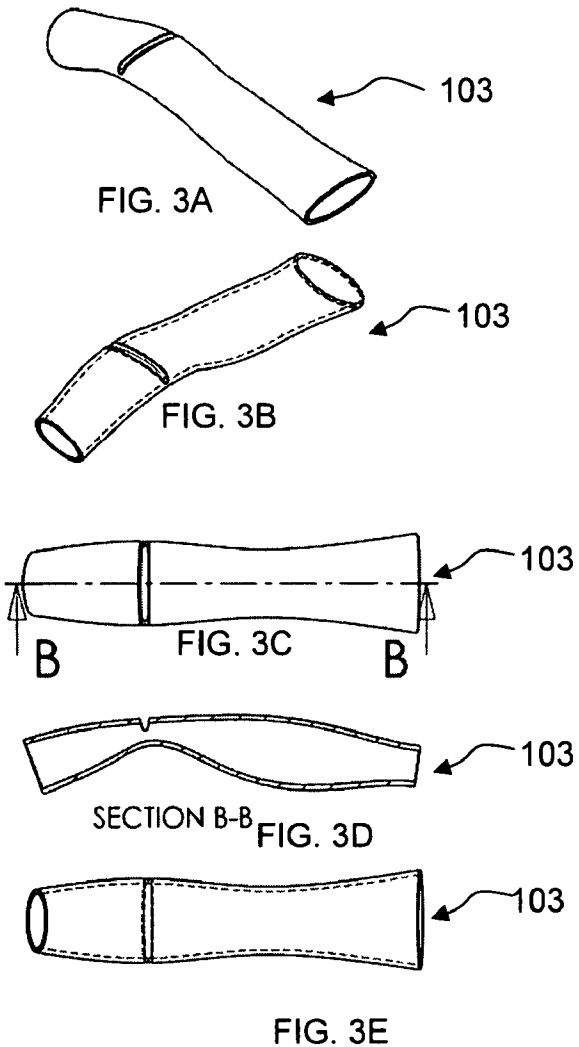
103
FIG. 3A
103
FIG. 3B
103
B
B
FIG. 3C
103
SECTION B-B
FIG. 3D
103
FIG. 3E 105
142

F
F
105
142

105
142
SECTION F-F 105
142

143
106

106
143

J
J
106
143

106
143
SECTION J-J 106
143

107
144

107
144

107
144
H
H 107
144
SECTION H-H 107
144

SECTION J-J

SECTION B-B

FOODSTUFF-BASED WIND INSTRUMENT

RELATED APPLICATIONS

This application claims the benefit of prior filed U.S. provisional application No. 61/051,113, entitled "Foodstuff-Based Wind instrument", filed on May 7, 2008, said provisional application being hereby incorporated by way of reference as if fully set forth herein.

FIELD OF THE INVENTION

Generally, the present invention relates to the field of foodstuff, and particularly, to flour-based foodstuff such as dried dough for the cooking of pasta.

BACKGROUND OF THE INVENTION

The construction of instruments made of foodstuff, such as hardened candy, for the amusement of children, has long been known. For example, U.S. Pat. No. 6,183,334 issued to Gant discloses a whistle that is constructed of a body, preferably of an edible material such as candy, which includes a through air entry located transversely within the body. The air entry connects to an exhaust chamber which is located longitudinally within the body. The air exhaust chamber terminates at an air exhaust opening formed within the top surface of the body. The air exhaust chamber is triangularly shaped and tapered to be the narrowest at its pointed tip. The body may be mounted on a supporting stick.

Pasta having shapes resembling musical instruments is also known in the art. For example, U.S. Design Pat. No. 293,615 as well as U.S. Design Pat. No. 293,616, both issued to Blatnick, disclose the ornamental design for a trumpet-shaped and saxophone-shaped pasta piece, respectively.

SUMMARY OF THE INVENTION

In accordance with the disclosed invention, there is thus provided a wind instrument made of flour based foodstuff, such as a dried dough piece that can be used to prepare pasta. The wind instrument is formed as a tubular envelope defining a cavity with a first end and a second end, where the first end is open, enabling a user of the wind instrument to blow air into the open end to generate sound while the second end is being sealed. A labium opening is formed on the tubular envelope. The second end of the cavity may be opened and selectively sealed, such as by pressing a finger of the user thereon. Alternatively, the second end of the cavity may be fixedly sealed, such as during the manufacturing of the wind instrument. The tubular envelope may also have at least one fingerhole disposed on a portion thereof, where the fingerhole is selectively openable and closeable, while the user is blowing into the open end of the cavity. The cross-sectional shape of the tubular envelope may be circular, elliptical, rectangular, triangular, pentagonal, or any combination thereof. The longitudinal shape of the tubular envelope may be straight, curved, helical, S-shaped, or any combination thereof.

In accordance with the disclosed invention, there is further provided a dried dough piece for the preparation of pasta, which is operable as a wind instrument. The dried dough piece is formed as a tubular envelope defining a cavity with a first end and a second end, where the first end is open, enabling a user of the dried dough piece to blow air into the open end to generate sound while the second end is being sealed. A labium opening is formed on the tubular envelope. The second end of the cavity may be opened and selectively sealed, such as by pressing a finger of the user thereon. Alternatively, the second end of the cavity may be fixedly sealed, such as during the manufacturing of the wind instrument. The tubular envelope may also have at least one fingerhole disposed on a portion thereof, where the fingerhole is selectively openable and closeable, while the user is blowing into the open end of the cavity. The cross-sectional shape of the tubular envelope may be circular, elliptical, rectangular, triangular, pentagonal, or any combination thereof. The longitudinal shape of the tubular envelope may be straight, curved, helical, S-shaped, or any combination thereof.

In accordance with the disclosed invention, there is further provided a method for manufacturing a wind instrument. The method includes the procedure of shaping flour based foodstuff to a tubular envelope defining a cavity. The foodstuff may be a dried dough piece that can be used to prepare pasta. The method further includes the procedure of cutting the tubular envelope to form a first end and a second end, where the first end is open, enabling a user of the wind instrument to blow air into the open end to generate sound while the second end is being sealed. The method further includes the optional procedure of compressing a portion of the tubular envelope, for narrowing the diameter of the cavity at that portion. The method further includes the optional procedure of sealing the second end of the tubular envelope, while the open end is deformable without breaking the foodstuff. The method further includes the procedure of hardening the flour based foodstuff, such as by drying. The method further includes the procedure of cutting an opening constituting a labium on a portion of the tubular envelope, such as on the compressed portion thereof.

BRIEF DESCRIPTION OF THE DRAWINGS

These and further features and advantages of the invention will become more clearly understood in the light of the ensuing description of some embodiments thereof, given by way of example only, with reference to the accompanying figures, wherein:

FIG. 3A, FIG. 3B, FIG. 3C, FIG. 3D, FIG. 3E are schematic isometric top view, isometric bottom view, top view, side cross-sectional view along section B-B of FIG. 3C, and bottom view illustrations, respectively, of a foodstuff-based wind instrument according to a further embodiment of the invention;

FIG. 3F, FIG. 3G, FIG. 3H, FIG. 3I, FIG. 3J are schematic isometric top view, isometric bottom view, top view, side cross-sectional view along section D-D of FIG. 3H, and bottom view illustrations, respectively, of a foodstuff-based wind instrument according to yet a further embodiment of the invention;

Figures 1A, 1B, 1C, 1D:
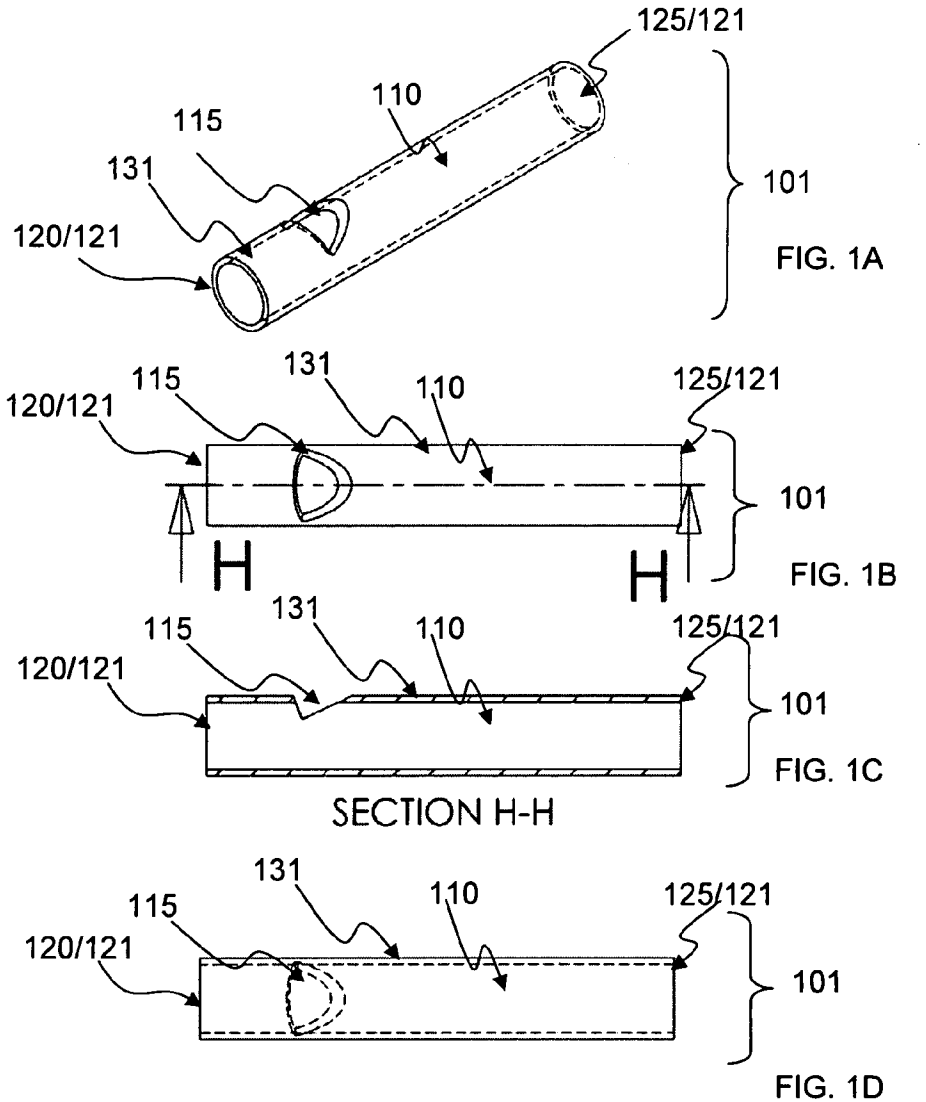
FIG. 1A, FIG. 1B, FIG. 1C and FIG. 1D are general schematic isometric, top view, side cross-sectional view along section H-H of FIG. 1B, and bottom view illustrations, respectively, of a foodstuff-based wind instrument, according to an embodiment of the invention.
Figures 2A, 2B, 2C, 2D, 2E:
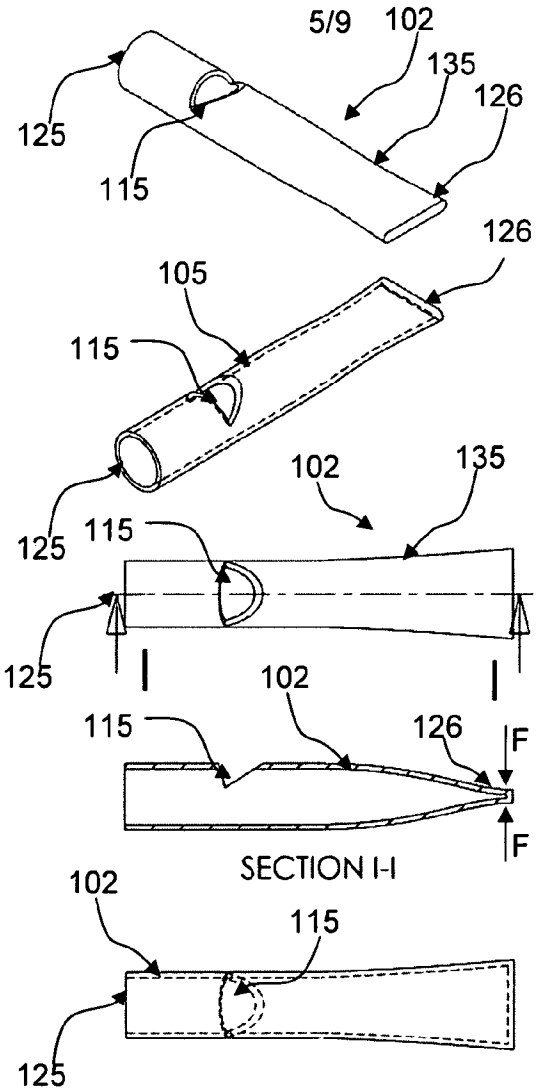
FIG. 2A, FIG. 2B, FIG. 2C, FIG. 2D and FIG. 2E are schematic isometric top view, isometric bottom view, top view, side cross-sectional view along section I-I of FIG. 2C, and bottom view illustrations, respectively, of a foodstuff-based wind instrument according to another embodiment of the invention.
Figures 4A, 4B, 4C, 4D, 4E, 4F, 4G, 4H, 4I, 4J, 4K, 4L, 4M, 4N:
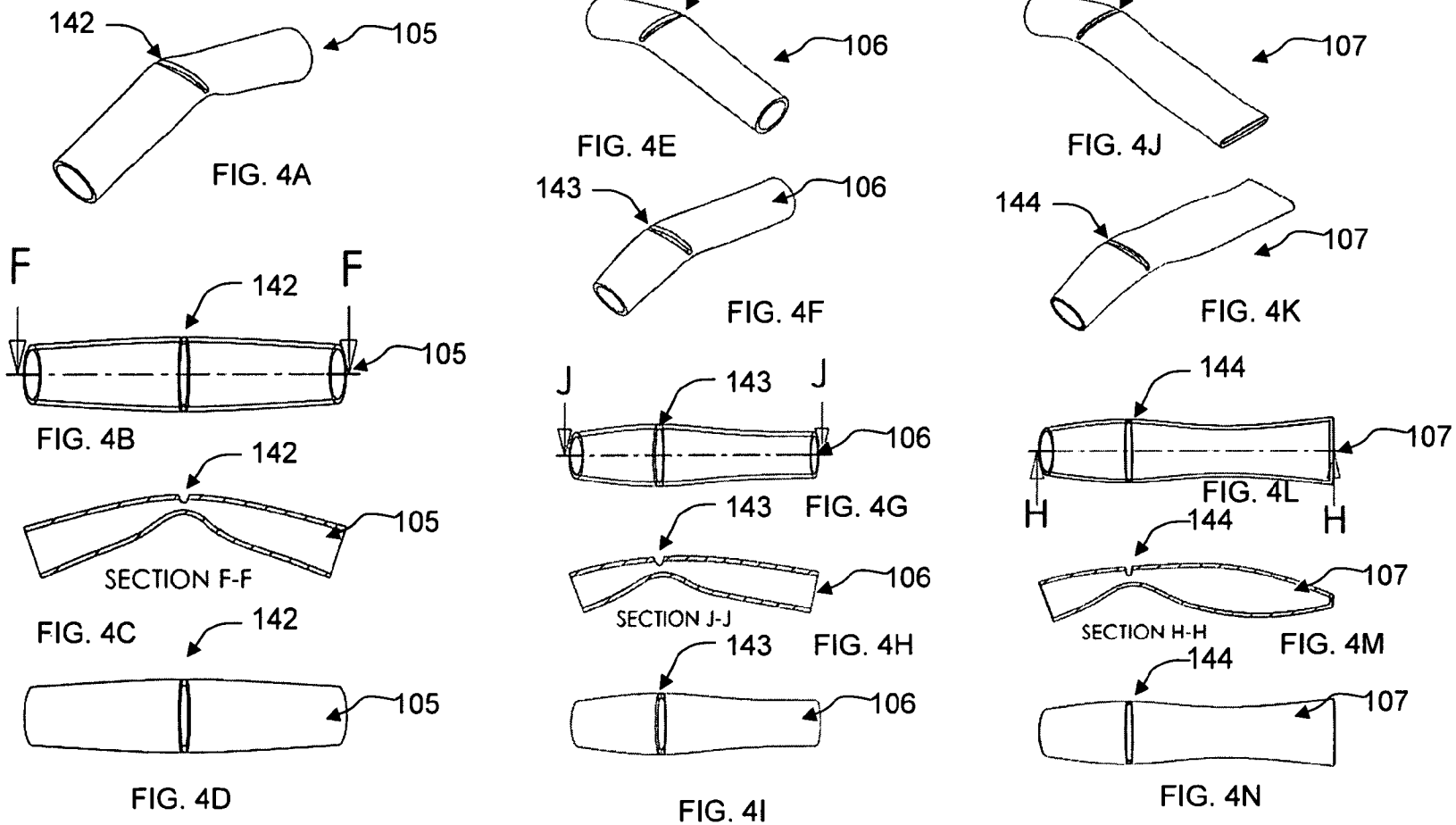
FIG. 4A, FIG. 4B, FIG. 4C, and FIG. 4D are schematic isometric, top view, side cross-sectional view along section F-F of FIG. 4B, and bottom view illustrations, respectively, of a foodstuff-based wind instrument according to yet another embodiment of the invention.
FIG. 4E, FIG. 4F, FIG. 4G, FIG. 4H, and FIG. 4I are schematic isometric, isometric, top view, side cross-sectional view along section J-J of FIG. 4G, and bottom view illustrations, respectively, of a foodstuff-based wind instrument according to yet a further embodiment of the invention.
FIG. 4J, FIG. 4K, FIG. 4L, FIG. 4M, and FIG. 4N are schematic isometric, isometric, top view, side cross-sectional view along section H-H of FIG. 4L, and bottom view illustrations, respectively, of a foodstuff-based wind instrument according to yet another embodiment of the invention.

The drawings taken with the description make apparent to those skilled in the art how the invention may be embodied in practice.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate identical and analogous elements but may not be referenced in the description for all figures.

DETAILED DESCRIPTION OF THE EMBODIMENTS

The present invention discloses a wind instrument made of a suitable foodstuff, and which is configured such that a user thereof blowing into an air entry of the wind instrument causes the vibration of a column of air in the instrument's cavity, thereby generating sound.

In accordance with an embodiment of the present invention, the foodstuff comprises flour. Accordingly, the wind instrument may be made of the same ingredients as pasta (i.e., at least dried dough). Consequently, a plurality of edible wind instruments may for example be offered in packages for sale to potential buyers, whereby a buyer of such a package may for example use some of the wind instruments for amusement of, e.g., his children by generating a sound therewith, and later process (e.g. cook) the same wind instruments to render the foodstuff of which the wind instruments are made of edible.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Referring now to FIG. 1A, FIG. 1B, FIG. 1C and FIG. 1D, a wind instrument 101 according to an embodiment of the invention comprises an envelope defining a tubular body 131 having a resonator cavity 110.

It should be noted that terms "tubular body", "tubular envelope", and grammatical variations thereof as used herein, refers to any envelope defining a hollow cavity, wherein the cross-section of the envelope may define any kind of closed curve.

Wind instrument 101 has a first end 120 and second end 125, wherein first end 120 and second end 125 may selectably constitute an air entry 121 and a sealable opening of resonator cavity 110. Additionally, wind instrument 101 further includes a labium opening 115, which is an opening of resonator cavity 110 to the air ambient and which is disposed across a middle portion of tubular body 131. If one end of resonator cavity 110 is sealed and a user of wind instrument 101 blows via the other end into resonator cavity 110, the oscillation of air in resonator cavity 110 may be effected, which may result in the generation of sound. Each portion of resonator cavity 110 on either side of labium opening 115 may vary and/or differ in length and/or shape, thereby influencing the tone and/or tone pitch that may be generated by means of resonator cavity 110.

It should further be noted that the termination of resonator cavity 110 may be sealed by various means. For example, a tip (e.g. second end 125) of resonator cavity 110 may be sized such that it is sealable by a finger of a user blowing into wind instrument 101. Alternatively, the respective tip of resonator cavity 110 may, for example, be tapered to achieve sealing of the same tip of resonator cavity 110. Thusly configured, wind instrument 101 may in some embodiments of the invention constitute a whistle. It should be noted that if wind instrument 101 is made of dough or any other material that undergoes hardening, then such tapering may be performed prior to or after the hardening process.

Additional reference is now made to FIG. 2A, FIG. 2B, FIG. 2C, FIG. 2D, FIG. 2E, FIG. 3A, FIG. 3B, FIG. 3C, FIG. 3D, FIG. 3E, FIG. 3F, FIG. 3G, FIG. 3H, FIG. 3I, FIG. 3J, FIG. 4A, FIG. 4B, FIG. 4C, FIG. 4D, FIG. 4E, FIG. 4F, FIG. 4G, FIG. 4H, FIG. 4I, FIG. 4J, FIG. 4K, FIG. 4L, FIG. 4M, FIG. 4N, FIG. 5A, FIG. 5B, FIG. 5C, FIG. 5D, FIG. 6A, FIG. 6B and FIG. 6C, FIG. 7A, FIG. 7B and FIG. 7C which schematically illustrate further embodiments of wind instrument 101.

In some embodiments of the invention, air entry 121 of respective wind instruments 102, 103 104, 105, 106 and 107 may have different shapes. For example, air entry 121 may be cup-shaped or tapered.

Specifically referring now to FIG. 2A, FIG. 2B, FIG. 2C, FIG. 2D and FIG. 2E, wind instrument 102 has a second end 126 that is fixedly sealed. Such sealing may be achieved, for example, by exerting forces (F) against the envelope of wind instrument 102, to cause the reshaping of second end 125 into a sufficiently tapered form, and consequently result in a sealed second end 126 and a substantially flat or compressed portion 135.

Specifically referring now to FIG. 4A, FIG. 4B, FIG. 4C and FIG. 4D, wind instrument 105 has two open ends, and includes a compressed or bent portion 142 located substantially in the center of wind instrument 105. The cavity of wind instrument 105 is narrower at bent portion 142. A labium opening 115 is formed in the bent portion 142 of wind instrument 105.

Specifically referring now to FIG. 4E, FIG. 4F, FIG. 4G, FIG. 4H and FIG. 4I, wind instrument 106 has two open ends, and includes a compressed or bent portion 143 located in a middle portion of wind instrument 106, closer to one of the two ends (i.e., not in the center thereof). A labium opening 115 is formed in the bent portion 143 of wind instrument 106.

Specifically referring now to FIG. 4J, FIG. 4K, FIG. 4L, FIG. 4M and FIG. 4N, wind instrument 107 has one open end and one sealed end, and includes a compressed or bent portion 144 located in a middle portion of wind instrument 107, closer to the open end (i.e., not in the center thereof). A labium opening 115 is formed in the bent portion 144 of wind instrument 107.

Specifically referring now to FIG. 5A, FIG. 5B, FIG. 5C and FIG. 5D, wind instrument 108 further includes at least one fingerhole 130. Closing and opening at least partially one or more fingerholes 130 (e.g., with a finger) while blowing into air entry 121 changes the effective volume of the vibrating air column. Consequently, an alteration of the air's frequency of vibration in resonator cavity 110 is effected, which in turn changes the musical note and/or the note's pitch sounding from wind instrument 108.

Figure 5A:
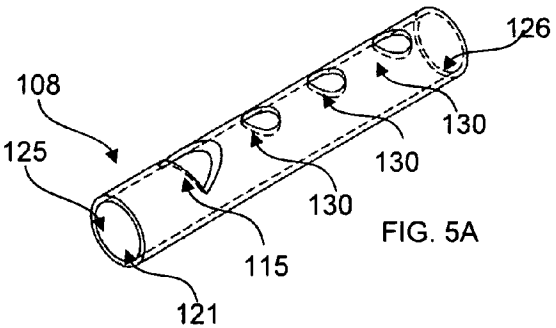
FIG. 5A, FIG. 5B, FIG. 5C and FIG. 5D are schematic isometric, top view, side cross-sectional view along section J-J of FIG. 5B, and bottom view illustrations, respectively, of a foodstuff-based wind instrument according to yet a further embodiment of the invention.
Figure 5B:
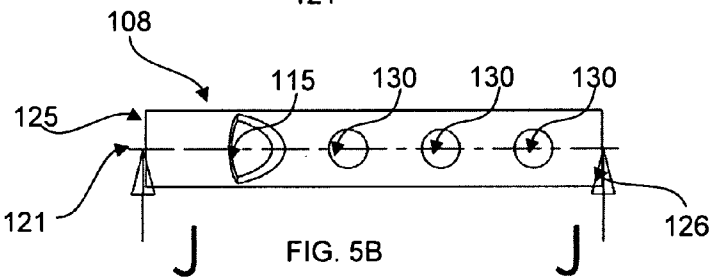
Figure 5C:
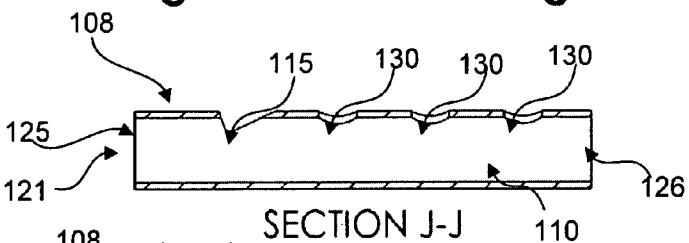
Figure 5D:
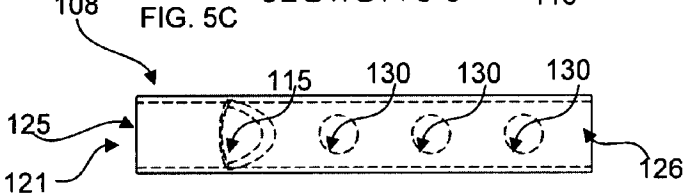

With reference to FIG. 5B, both ends 125 and 126 of a wind instrument 102 may be open to the ambient. Moreover, labium 115 may be located off-centered with respect to the overall length of wind instrument 102. Thusly configured, each end 125 and 126 may selectably constitute an air inlet and be closeable by, e.g., a finger of the user, where the blowing of air into either one end 125 and 126, whilst closing the corresponding other end, results in different tones, due to the respective different volumes of resonator cavity in wind instrument 102 created by the off-centered location of labium 115.

It should be noted that wind instrument 101 and embodiments thereof may be made of edible material such as, for example, dried dough, in its hardened or rigid form. In some embodiments of the invention, wind instrument 101 may for example be made of dried dough and shaped to have the functionality that is respectively analogous to, e.g., a panpipe, a mouth harmonica, or any other typically wood and/or plastic-based wind instrument.

Figure 6A:
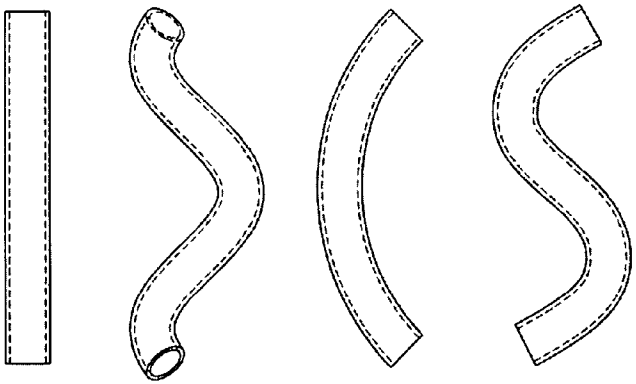
FIG. 6A, FIG. 6B and FIG. 6C are schematic side view, isometric, and front view illustrations, respectively, of foodstuff-based wind instruments having various longitudinal shapes, according to respective embodiments of the invention.
Figure 6B:
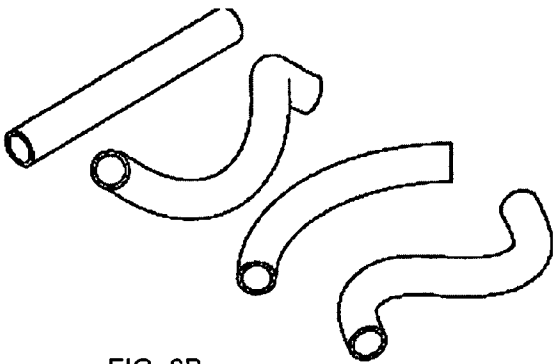
Figure 6C:
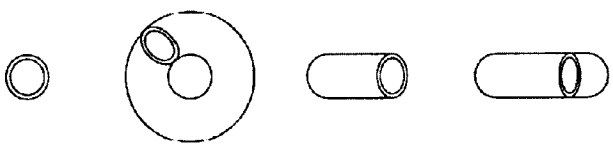

Specifically referring now to FIG. 6A, FIG. 6B and FIG. 6C, according to corresponding embodiments of the invention, the longitudinal section of tubular body 131 delineates at least one of the following shapes: straight, curved, helical, and S-shaped.

Figure 7A:
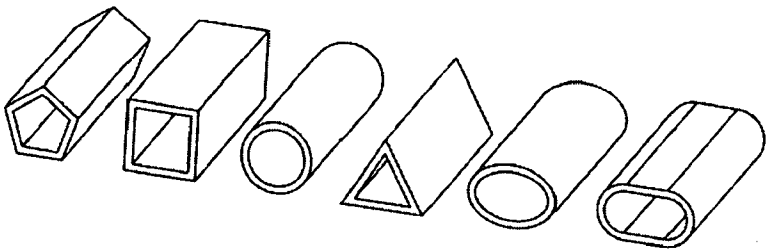
FIG. 7A, FIG. 7B and FIG. 7C are schematic isometric side view, top view and front view illustrations, respectively, of foodstuff-based wind instruments having various cross-sectional shapes, according to respective embodiments of the invention.
Figure 7B:
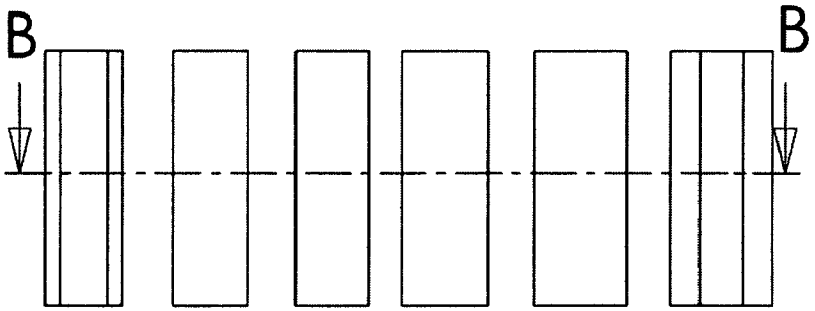
Figure 7C:
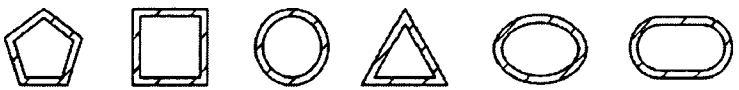

Specifically referring now to FIG. 7A, FIG. 7B and FIG. 7C, according to corresponding embodiments of the invention, the cross-section of tubular body 131 of wind instruments delineates at least one of the following shapes: elliptic, circular, rectangular, triangular and pentagonal.

Figure 8:
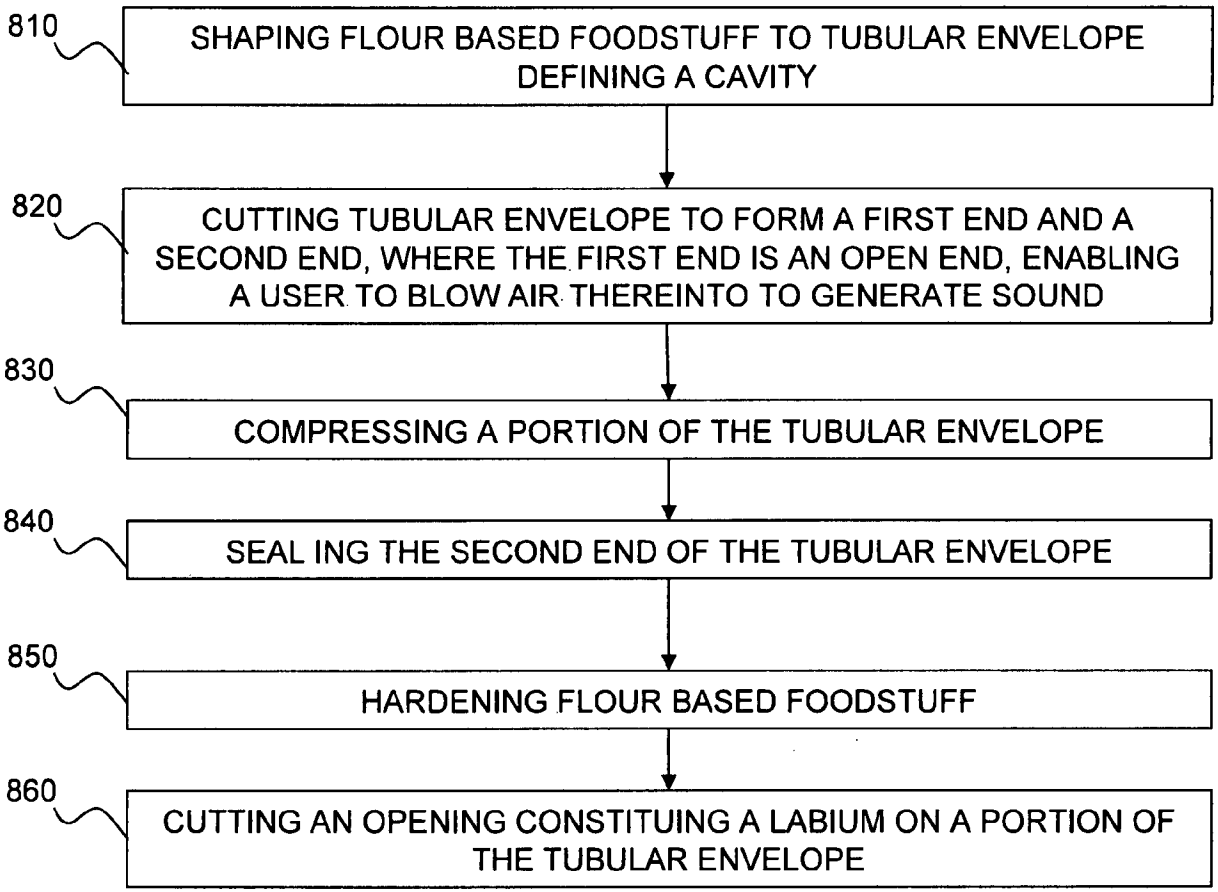
FIG. 8 is a flow-chart illustration of a method for manufacturing a foodstuff-based wind instrument, according to an embodiment of the invention.

Reference is now made to FIG. 8. As indicated by box 810, the method for manufacturing a wind instrument includes the procedure of shaping flour based foodstuff (e.g. a dried dough piece) to a tubular envelope defining a cavity. Referring back to FIG. 1A, flour based foodstuff, such as dried dough for the preparation of pasta, is formed into tubular body 131 defining resonator cavity 110.

As indicated by box 820, the method further includes the procedure of cutting the tubular envelope to form a first end and a second end, where the first end is an open end, enabling a user of the wind instrument to blow air thereinto to generate sound while the second end is being sealed. Referring back to FIG. 1A, tubular body 131 is cut to form a first end 120 and a second end 125, such that when a user blows into open end 120 while sealing the other end 125 (e.g., by pressing a finger to seal the end), it results in the generation of sound from tubular body 131.

As indicated by box 830, the method further includes the optional procedure of compressing a portion of the tubular envelope, for narrowing the diameter of the cavity at the portion. The compressing may be achieved by bending the tubular envelope. The compressing may also result in the formation of different shapes for the tubular envelope. Referring back to FIG. 4A, FIG. 4B, FIG. 4C, and FIG. 4D, wind instrument 105 is compressed at section 142, resulting in a narrowed resonator cavity 110 at section 142 of wind instrument 105.

As indicated by box 840, the method further includes the optional procedure of sealing the second end of the tubular envelope. The sealing process is performed prior to hardening the foodstuff (procedure 850), when the open end is deformable without causing breaking of the flour based foodstuff. Referring back to FIG. 2A, FIG. 2B, FIG. 2C, FIG. 2D, and FIG. 2E, second end of tubular body 131 is fixedly sealed, resulting in sealed end 126.

As indicated by box 850, the method further includes the procedure of hardening the flour based foodstuff. The hardening process may be performed by drying the foodstuff.

As indicated by box 860, the method further includes the procedure of cutting an opening constituting a labium on a portion of the tubular envelope. It is noted that procedure 860 may alternatively be performed prior to hardening the foodstuff (procedure 850). The labium is generally disposed in a middle portion of the tubular envelope. Referring back to FIG. 1A, FIG. 1B, FIG. 1C, and FIG. 1D, labium 115 is cut into a portion of tubular body 131. Referring back to FIG. 4A, FIG. 4B, and FIG. 4C, labium 115 may be formed in the compressed section 142 of tubular body 131.

While the invention has been described with respect to a limited number of embodiments, these should not be construed as limitations on the scope of the invention, but rather as exemplifications of some of the embodiments. Those skilled in the art will envision other possible variations, modifications, and programs that are also within the scope of the invention. Accordingly, the scope of the invention should not be limited by what has thus far been described. Therefore, it should be understood that alternatives, modifications, and variations of the present invention are to be construed as being within the scope of the appended claims.

What is claimed is:

1. A wind instrument comprising a tubular envelope defining a resonator cavity, said envelope being made of flour based foodstuff, said tubular envelope defining a cavity with a first end and a second end, wherein said first end is an open end, enabling a user of said wind instrument to blow air thereinto to generate sound while said second end is being sealed, said envelope comprising a labium opening disposed on a portion thereof.

2. The wind instrument of claim 1, wherein said second end is an open end and is selectively sealable, by pressing thereon a finger of said user.

3. The wind instrument of claim 1, wherein said second end is fixedly sealed.

4. The wind instrument of claim 1, further comprising at least one fingerhole disposed on a portion of said envelope, said fingerhole being selectively openable and closeable with a finger of said user whilst blowing into said open end.

5. The wind instrument of claim 1, wherein said tubular envelope comprises a cross-sectional shape selected from the list consisting of: circular; elliptical; rectangular; triangular; and pentagonal.

6. The wind instrument of claim 1, wherein said tubular envelope comprises a longitudinally shaped body selected from the list consisting of: straight; curved; helical; and S-shaped.

7. Dried dough piece for the preparation of pasta, wherein the dried dough piece is operable as a wind instrument, said dried dough piece comprising a tubular envelope defining a cavity with a first end and a second end, wherein said first end is an open end, enabling a user of said dried dough piece to blow air thereinto to generate sound while said second end is being sealed, said envelope comprising a labium opening disposed on a portion thereof.

8. The dried dough piece of claim 7, wherein said second end is an open end and is selectively sealable, by pressing thereon a finger of said user.

9. The dried dough piece of claim 7, wherein said second end is fixedly sealed.

10. The dried dough piece of claim 7, further comprising at least one fingerhole disposed on a portion of said envelope, said fingerhole being selectively openable and closeable with a finger of said user whilst blowing into said open end.

11. The dried dough piece of claim 7, wherein said tubular envelope comprises a cross-sectional shape selected from the list consisting of: circular; elliptical; rectangular; triangular; and pentagonal.

12. The dried dough piece of claim 7, wherein said tubular envelope comprises a longitudinally shaped body selected from the list consisting of: straight; curved; helical; and S-shaped.

13. A method for manufacturing a wind instrument, said method comprising the following procedures:

a) shaping flour based foodstuff to a tubular envelope defining a cavity;

b) cutting said tubular envelope to form a first end and a second end, wherein said first end is an open end, enabling a user of said wind instrument to blow air thereinto to generate sound while said second end is being sealed;

c) hardening said flour based foodstuff; and d) cutting an opening constituting a labium on a portion of said tubular envelope.

14. The method of claim 13, wherein said foodstuff is a dried dough piece, for the preparation of pasta.

15. The method of claim 13, further comprising the procedure of sealing said second end prior to said procedure of hardening.

16. The method of claim 13, further comprising the procedure of compressing a portion of said tubular envelope, for narrowing the diameter of said cavity at said portion.

17. The method of claim 14 wherein said procedure of cutting an opening is conducted in said compressed portion.

* * * * *